US009417645B2

(12) United States Patent
Utsunomiya

(10) Patent No.: US 9,417,645 B2
(45) Date of Patent: Aug. 16, 2016

(54) VOLTAGE REGULATOR

(71) Applicant: Seiko Instruments Inc., Chiba-shi, Chiba (JP)

(72) Inventor: Fumiyasu Utsunomiya, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 155 days.

(21) Appl. No.: 14/196,657

(22) Filed: Mar. 4, 2014

(65) Prior Publication Data

US 2014/0253068 A1 Sep. 11, 2014

(30) Foreign Application Priority Data

Mar. 6, 2013 (JP) ..... 2013-044165
Jan. 10, 2014 (JP) ..... 2014-002971

(51) Int. Cl.
*G05F 1/56* (2006.01)
*G05F 1/565* (2006.01)

(52) U.S. Cl.
CPC . *G05F 1/56* (2013.01); *G05F 1/565* (2013.01)

(58) Field of Classification Search
CPC ..... G05F 1/462; G05F 1/56; G05F 1/565; G05F 1/571; G05F 1/575
USPC ..... 323/312–316, 373, 276–278, 282; 327/539–541
See application file for complete search history.

(56) References Cited

U.S. PATENT DOCUMENTS 7,816,897 B2 * 10/2010 Illegems ..... G05F 3/262 323/274
2014/0253076 A1 * 9/2014 Utsunomiya ..... G05F 1/565 323/282

FOREIGN PATENT DOCUMENTS

JP 2005-092693 A 4/2005

* cited by examiner

*Primary Examiner* — Jue Zhang
*Assistant Examiner* — Kyle J Moody
(74) *Attorney, Agent, or Firm* — Brinks Gilson & Lione

(57) ABSTRACT

Provided is a voltage regulator capable of controlling an output voltage to a predetermined voltage quickly after an overshoot occurs in the output voltage. The voltage regulator includes: an overshoot detection circuit configured to detect a voltage that is based on an output voltage of the voltage regulator, and output a current corresponding to an overshoot amount of the output voltage; and an I-V converter circuit configured to control a current flowing through an output transistor based on a current controlled by an output of an error amplifier and a current flowing from the overshoot detection circuit.

8 Claims, 4 Drawing Sheets

VOLTAGE REGULATOR

RELATED APPLICATIONS

This application claims priority under 35 U.S.C. §119 to Japanese Patent Application Nos. 2013-044165 filed on Mar. 6, 2013 and 2014-002971 filed on Jan. 10, 2014, the entire contents of which are hereby incorporated by reference.

BACKGROUND OF THE INVENTION

1. Field of the Invention

The present invention relates to an improvement in overshoot in a voltage regulator.

2. Description of the Related Art

FIG. 3 illustrates a circuit diagram of a related-art voltage regulator. The related-art voltage regulator includes an error amplifier 110, PMOS transistors 120 and 201, an NMOS transistor 202, resistors 211, 212, 213, and 214, capacitors 231 and 232, a power supply terminal 100, a ground terminal 101, a reference voltage terminal 102, and an output terminal 103.

The error amplifier 110 controls a gate of the PMOS transistor 120, and an output voltage Vout is thereby output from the output terminal 103. The output voltage Vout has a value determined by dividing a voltage of the reference voltage terminal 102 by a total resistance value of the resistor 212 and the resistor 213 and multiplying the resultant value by a total resistance value of the resistor 211, the resistor 212, and the resistor 213. In order to reduce an overshoot of the output voltage Vout, the PMOS transistor 201, the NMOS transistor 202, and the resistor 214 are provided. When an overshoot occurs, the NMOS transistor 202 is turned on to cause a current to flow through the resistor 214. Then, a voltage is generated across the resistor 214 to turn on the PMOS transistor 201. When the PMOS transistor 201 is turned on, the gate of the PMOS transistor 120 is pulled up to a power supply voltage to turn off the PMOS transistor 120. In this manner, an increase in overshoot can be prevented (see, for example, Japanese Patent Application Laid-open No. 2005-92693).

In the related-art voltage regulator, however, there is a problem in that it may take time to control so that a predetermined output voltage may be output from the state in which an overshoot occurs and the PMOS transistor 120 is turned off. Further, there is another problem in that an output current may become insufficient to decrease the output voltage while the output voltage is controlled to be a predetermined output voltage from the state in which an overshoot occurs and the PMOS transistor is turned off.

SUMMARY OF THE INVENTION

The present invention has been made in view of the above-mentioned problems, and provides a voltage regulator that reduces time required for control of an output voltage after an overshoot occurs in the output voltage, thereby preventing the output voltage from being decreased due to an insufficient output current.

In order to solve the related-art problems, a voltage regulator according to one embodiment of the present invention is configured as follows.

The voltage regulator includes: an error amplifier; an output transistor; and an overshoot detection circuit configured to detect a voltage that is based on an output voltage of the voltage regulator, and output a current corresponding to an overshoot amount of the output voltage, in which, in accordance with the current, a current flowing through the output transistor is decreased.

According to the voltage regulator according to one embodiment of the present invention, the output voltage can be controlled to a predetermined voltage quickly after an overshoot occurs in the output voltage.

DETAILED DESCRIPTION OF THE PREFERRED EMBODIMENT

Now, an embodiment of the present invention is described below with reference to the accompanying drawings.

Embodiment

Figure 1:
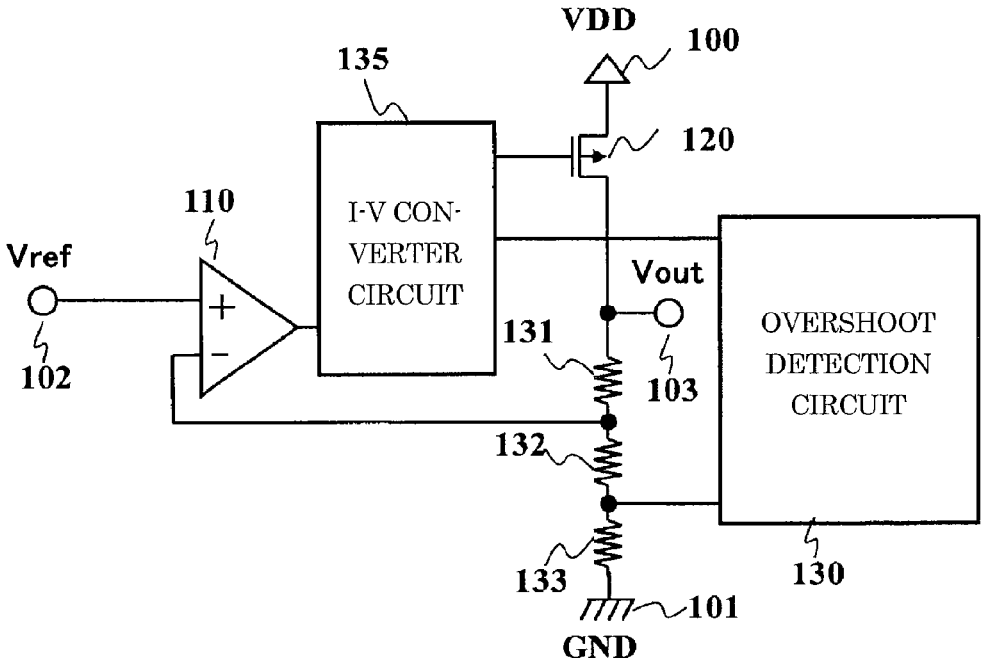
FIG. 1 is a block diagram of a voltage regulator according to an embodiment of the present invention.
Figure 2:
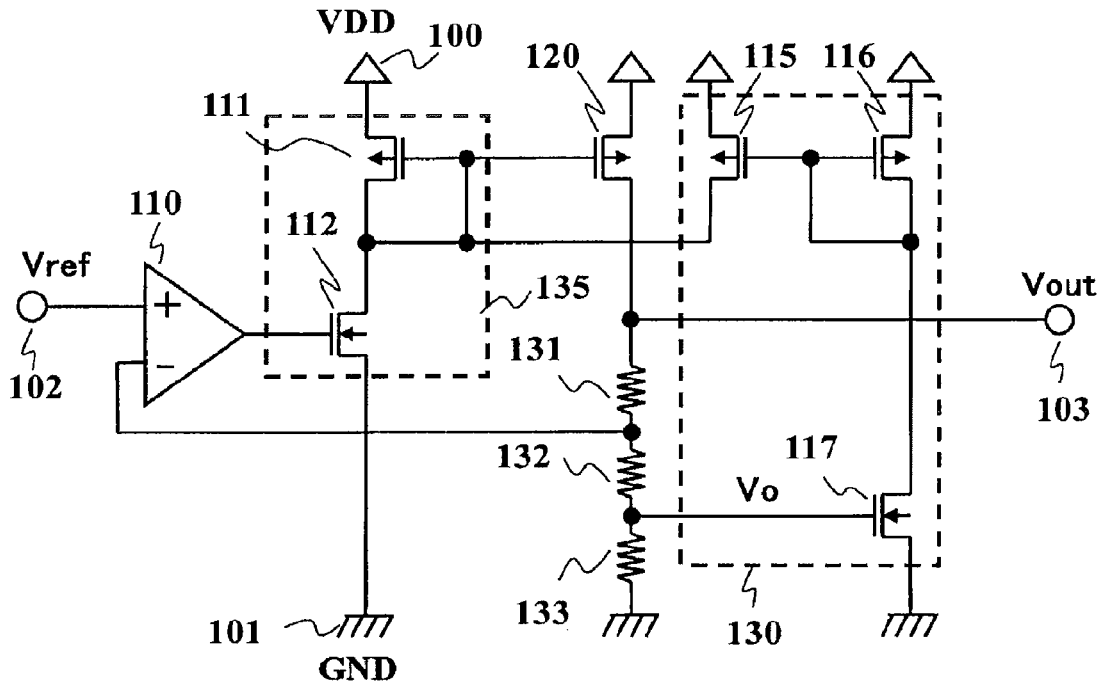
FIG. 2 is a circuit diagram of the voltage regulator according to the embodiment of the present invention.
Figure 3:
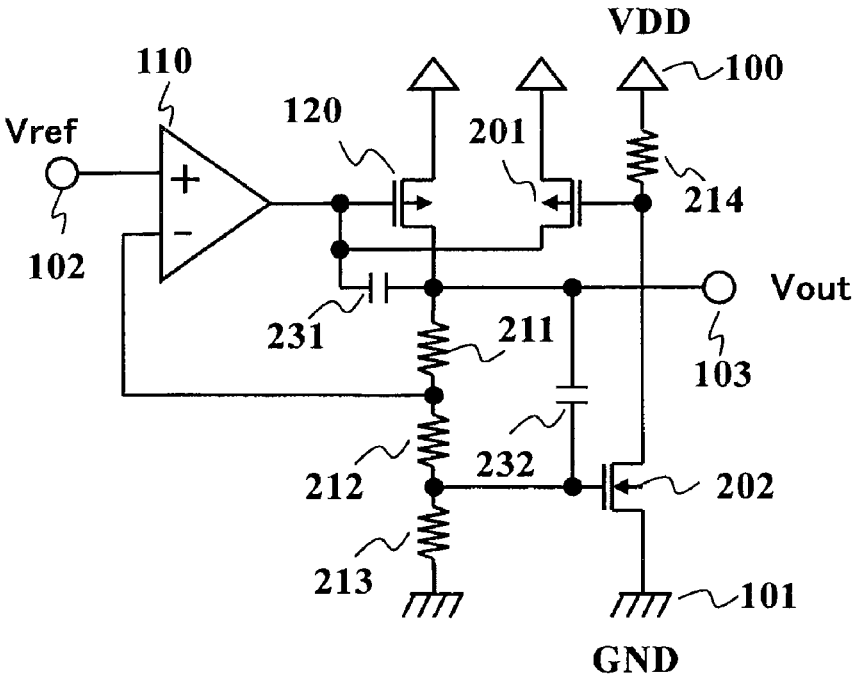
FIG. 3 PRIOR ART
FIG. 3 is a circuit diagram of a related-art voltage regulator.

FIG. 1 is a block diagram of a voltage regulator according to an embodiment of the present invention. The voltage regulator according to this embodiment includes an error amplifier 110, a PMOS transistor 120, resistors 131, 132, and 133, an overshoot detection circuit 130, an I-V converter circuit 135, a power supply terminal 100, a ground terminal 101, a reference voltage terminal 102, and an output terminal 103. The PMOS transistor 120 operates as an output transistor. FIG. 2 is a circuit diagram of the voltage regulator according to this embodiment. The overshoot detection circuit 130 includes PMOS transistors 115 and 116 and an NMOS transistor 117. The I-V converter circuit 135 includes a PMOS transistor 111 and an NMOS transistor 112.

Next, connections in the voltage regulator according to this embodiment are described. The error amplifier 110 has a non-inverting input terminal connected to the reference voltage terminal 102, an inverting input terminal connected to a connection point between one terminal of the resistor 131 and one terminal of the resistor 132, and an output terminal connected to a gate of the NMOS transistor 112. The other terminal of the resistor 131 is connected to the output terminal 103 and a drain of the PMOS transistor 120. The NMOS transistor 112 has a drain connected to a gate and a drain of the PMOS transistor 111, and a source connected to the ground terminal 101. The PMOS transistor 111 has a source connected to the power supply terminal 100. The PMOS transistor 120 has a gate connected to the gate of the PMOS transistor 111 and a source connected to the power supply terminal 100. The PMOS transistor 115 has a gate connected to a gate and a drain of the PMOS transistor 116, a drain connected to the gate of the PMOS transistor 111, and a source connected to the power supply terminal 100. The PMOS transistor 116 has a source connected to the power supply terminal 100. The NMOS transistor 117 has a gate connected to a connection point between the other terminal of the resistor 132 and one terminal of the resistor 133, a drain connected to the drain of the PMOS transistor 116, and a source connected to the ground terminal 101. The other terminal of the resistor 133 is connected to the ground terminal 101.

An operation of the voltage regulator according to this embodiment is now described. The reference voltage terminal 102 is connected to a reference voltage circuit to input a reference voltage Vref.

The resistor 131 and the resistors 132 and 133 divide an output voltage Vout as a voltage of the output terminal 103, thereby outputting a divided voltage Vfb. The error amplifier 110 compares the reference voltage Vref to the divided voltage Vfb, and controls a gate voltage of the NMOS transistor 112 so that the output voltage Vout may be constant. When the output voltage Vout is higher than a target value, the divided voltage Vfb becomes higher than the reference voltage Vref, and an output signal of the error amplifier 110 (gate voltage of the NMOS transistor 112) decreases. Then, a current flowing through the NMOS transistor 112 is decreased. The PMOS transistor 111 and the PMOS transistor 120 construct a current mirror circuit. When the current flowing through the NMOS transistor 112 decreases, the current flowing through the PMOS transistor 120 also decreases. Because the output voltage Vout is set by the product of the current flowing through the PMOS transistor 120 and the resistances of the resistors 131, 132, and 133, when the current flowing through the PMOS transistor 120 decreases, the output voltage Vout decreases.

When the output voltage Vout is lower than a target value, the divided voltage Vfb becomes lower than the reference voltage Vref, and the output signal of the error amplifier 110 (gate voltage of the NMOS transistor 112) increases. Then, the current flowing through the NMOS transistor 112 is increased, and the current flowing through the PMOS transistor 120 is also increased. Because the output voltage Vout is set by the product of the current flowing through the PMOS transistor 120 and the resistances of the resistors 131, 132, and 133, when the current flowing through the PMOS transistor 120 increases, the output voltage Vout increases. In this manner, the output voltage Vout is controlled to be constant.

Through the operation described above, the I-V converter circuit 135 controls the current flowing through the output transistor 120 based on the current controlled by the output of the error amplifier 110.

The case is considered where an overshoot appears in the output terminal 103 and the output voltage Vout increases transiently. A voltage determined by dividing the output voltage Vout by the resistors 131 and 132 and the resistor 133 is represented by Vo. When the output voltage Vout increases transiently, the voltage Vo also increases to turn on the NMOS transistor 117, thereby causing a current to flow. The PMOS transistor 116 and the PMOS transistor 115 construct a current mirror circuit. When the NMOS transistor 117 causes a current to flow, the PMOS transistor 115 also causes a current to flow.

The voltage regulator operates so that the current from the PMOS transistor 115 may flow to the NMOS transistor 112, but because the output of the error amplifier 110 is not changed, the amount of the current that can be caused to flow to the NMOS transistor 112 is not changed, and the current from the PMOS transistor 115 cannot be caused to flow. Thus, the PMOS transistor 111 operates so as to decrease the current flowing from the PMOS transistor 111 to the NMOS transistor 112, thereby causing the current from the PMOS transistor 115 to flow to the NMOS transistor 112. Because the current flowing through the PMOS transistor 111 decreases, the current flowing through the PMOS transistor 120 also decreases. In this manner, the output voltage Vout is controlled not to increase any more, thereby stopping the increase in overshoot of the output voltage Vout.

After the overshoot occurs, when the output voltage Vout is controlled to decrease, the current flowing through the NMOS transistor 117 also gradually decreases, and the current of the PMOS transistor 115 also gradually decreases. Then, the current of the PMOS transistor 111 gradually increases to return to a normal current value, and the output voltage Vout is controlled to be constant. During this control, the PMOS transistor 120 is not turned off but operates to continue controlling the output voltage Vout. Consequently, the output voltage Vout can be controlled stably without being decreased due to an insufficient output current even immediately after the overshoot is eliminated.

Through the operation described above, the I-V converter circuit 135 controls the current flowing through the output transistor 120 based also on the current from the overshoot detection circuit 130.

Figure 4:
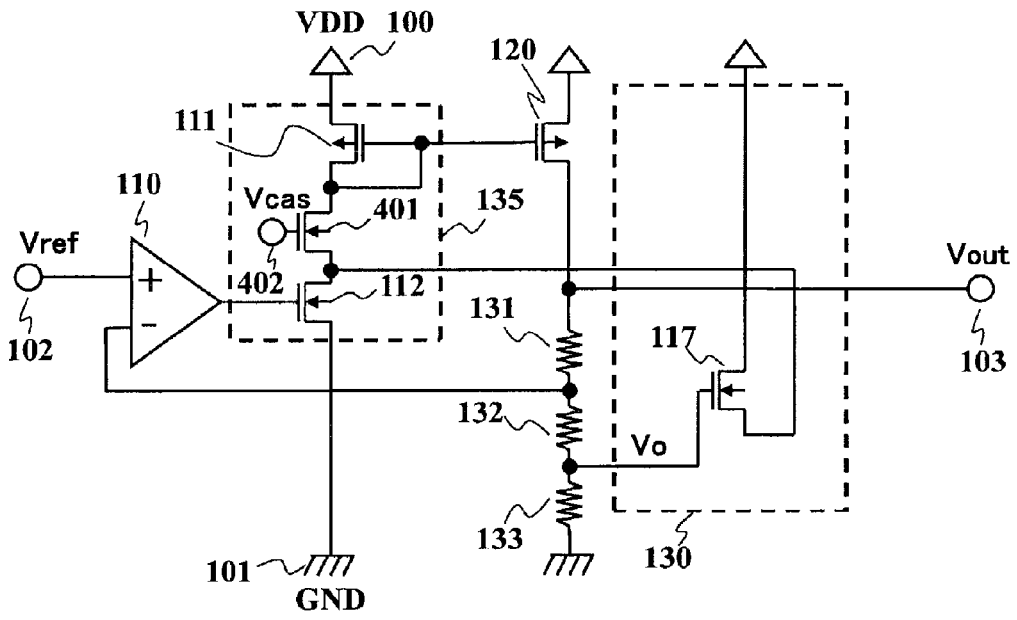
FIG. 4 is a circuit diagram illustrating another example of the voltage regulator according to the embodiment of the present invention.

FIG. 4 is a circuit diagram illustrating another example of the voltage regulator according to this embodiment. The overshoot detection circuit 130 and the I-V converter circuit 135 have different configurations from those of the circuits of FIG. 2. Specifically, the PMOS transistors 115 and 116 are deleted, and an NMOS transistor 401 as a cascode transistor is added.

The NMOS transistor 401 has a source connected to the drain of the NMOS transistor 112 and the source of the NMOS transistor 117, a gate connected to a cascode voltage input terminal 402 for inputting a cascode voltage Vcas, and a drain connected to the drain and gate of the PMOS transistor 111 and the gate of the PMOS transistor 120. The other circuit configurations are the same as those illustrated in FIG. 2, and hence descriptions thereof are omitted.

Similarly to the circuits of FIG. 2, the voltage regulator of FIG. 4 operates so that the current of the PMOS transistor 120 may decrease in accordance with the current flowing through the NMOS transistor 117. The description herein is made on the assumption that the NMOS transistor 117 and the NMOS transistor 401 are transistors having the same characteristics.

The cascode voltage Vcas to be input to the gate of the NMOS transistor 401 is set to be higher than the voltage Vo obtained when the output voltage Vout of the output terminal 103 is normal. Thus, when the output voltage Vout is a normal voltage, the NMOS transistor 117 causes no current to flow, and hence the current of the PMOS transistor 120 is controlled by the current of the NMOS transistor 112.

In this case, when an overshoot occurs in the output voltage Vout of the output terminal 103, the voltage Vo increases correspondingly. Then, based on the relationship between the cascode voltage Vcas and the voltage Vo, the current of the NMOS transistor 401 decreases, and the current of the NMOS transistor 117 increases. Thus, when the voltage Vo increases, the current of the PMOS transistor 120 decreases, and hence the overshoot of the output voltage Vout is reduced. When the voltage Vo decreases, the current of the PMOS transistor 120 is controlled by the current of the NMOS transistor 112. That is, the current of the PMOS transistor 120 becomes the normal state. Then, the output voltage Vout becomes stable at a desired voltage.

In this case, the cascode voltage Vcas is set appropriately depending on the voltage Vo set to detect the overshoot in the output voltage Vout.

The voltage regulator of FIG. 4 configured as described above is capable of transmitting the current of the NMOS transistor 117 to the PMOS transistor 120 not via a current mirror circuit, thereby being capable of reducing the transmission time. Consequently, as compared to the voltage regulator of FIG. 2, the speed of suppressing an overshoot is increased, and hence there is an advantage that an overshoot voltage amount is small. Besides, there is another effect that the number of transistors can be reduced to downsize the circuit.

Note that, the description has been given above by referring to FIG. 2 and FIG. 4 as the configuration of the overshoot detection circuit 130, but the present invention is not limited to this configuration. Any configuration can be used as long as an overshoot is detected and a current corresponding to an overshoot amount is output.

As described above, the voltage regulator according to this embodiment is capable of stopping an increase in overshoot occurring in the output voltage, and stably controlling the output voltage while preventing the output voltage from decreasing after the increase in overshoot is stopped.

What is claimed is:

1. A voltage regulator, comprising:

an error amplifier;

an output transistor; and an overshoot detection circuit configured to detect a voltage that is based on an output voltage of the voltage regulator, and output a current corresponding to an overshoot amount of the output voltage, the overshoot detection circuit including a current mirror circuit having a first output connected to a gate of the of the output transistor, and a current tracking transistor including a gate applied with the voltage based on the output voltage, wherein the current mirror circuit includes a second output connected to ground by the current tracking transistor, and wherein, in accordance with the current corresponding to an overshoot amount, a current flowing through the output transistor is decreased.

2. The voltage regulator according to claim 1, further comprising a current-to-voltage (I-V) converter circuit configured to control the current flowing through the output transistor based on a current controlled by an output of the error amplifier and a current flowing from the overshoot detection circuit.

3. The voltage regulator according to claim 2, wherein:

the current-to-voltage converter circuit comprises a first transistor controlled by the output of the error amplifier; and the current flowing through the output transistor is controlled based on a current flowing through the first transistor.

4. The voltage regulator according to claim 3, wherein the current-to-voltage converter circuit further comprises a second transistor connected to the first transistor, for causing the current to flow through the output transistor, the current flowing through the output transistor based on one of the current flowing through the first transistor and the current flowing from the overshoot detection circuit.

5. The voltage regulator according to claim 3, wherein the first transistor includes a gate connected to the output of the error amplifier and a drain connected to the gate of the output transistor.

6. The voltage regulator according to claim 4, wherein the second transistor includes a gate and a drain connected to the gate of the output transistor and a drain of the first transistor.

7. The voltage regulator according to claim 4, wherein the first output of the current mirror circuit of the overshoot detection circuit is further connected to the current-to-voltage converter circuit.

8. A voltage regulator an error amplifier;

an output transistor;

an overshoot detection circuit configured to detect a voltage that is based on an output voltage of the voltage regulator, and output a current corresponding to an overshoot amount of the output voltage; and a current-to-voltage (I-V) converter circuit comprising a first transistor controlled by the output of the error amplifier, a second transistor connected to the first transistor, and a cascode transistor provided between a drain of the first transistor and a drain of the second transistor; and the overshoot detection circuit further comprises a third transistor including a gate applied with the voltage that is based on the output voltage and a source connected to the drain of the first transistor.

* * * * *